US008919728B2

(12) United States Patent
Ludwig

(10) Patent No.: US 8,919,728 B2
(45) Date of Patent: Dec. 30, 2014

(54) UNITARY FORM FOR POURED FOUNDATION PAD AND METHOD

(71) Applicant: KWOLM Industries, LLC, Jenison, MI (US)

(72) Inventor: Peter N. Ludwig, Jenison, MI (US)

(73) Assignee: KWOLM Industries LLC, Jenison, MI (US)

( * ) Notice: Subject to any disclaimer, the term of this patent is extended or adjusted under 35 U.S.C. 154(b) by 0 days.

(21) Appl. No.: 14/039,528

(22) Filed: Sep. 27, 2013

(65) Prior Publication Data

US 2014/0096473 A1 Apr. 10, 2014

Related U.S. Application Data

(60) Provisional application No. 61/710,934, filed on Oct. 8, 2012.

(51) Int. Cl.
*E04G 11/36* (2006.01)
*E02D 27/01* (2006.01)
*E04G 13/00* (2006.01)

(52) U.S. Cl.
CPC ..... *E04G 13/00* (2013.01); *E02D 27/01* (2013.01)
USPC ..... 249/18; 52/742.14

(58) Field of Classification Search
CPC ..... E04G 13/00; E04G 13/02; E04G 13/023; E04G 17/001; E02D 27/013; B28B 7/0038; B28B 7/266
USPC ..... 52/742.14; 249/194, 48, 51, 18, 13, 163
See application file for complete search history.

(56) References Cited

U.S. PATENT DOCUMENTS

| | | | | | |
|---|---|---|---|---|---|
| 160,942 | A | * | 3/1875 | Murray | 217/5 |
| 394,650 | A | * | 12/1888 | Holl | 52/104 |
| 992,782 | A | * | 5/1911 | Lambie | 264/32 |
| 1,644,586 | A | * | 10/1927 | Heltzel | 249/5 |
| 3,021,586 | A | * | 2/1962 | Uruburu | 249/48 |
| 3,572,625 | A | * | 3/1971 | Williamsen | 249/117 |
| 3,672,626 | A | * | 6/1972 | Thornton | 249/48 |
| 3,730,475 | A | * | 5/1973 | Werfel et al. | 249/13 |
| 4,003,543 | A | * | 1/1977 | Doubleday et al. | 249/48 |
| 4,081,167 | A | * | 3/1978 | Heinzle | 249/10 |
| 4,091,928 | A | * | 5/1978 | Bernardo | 206/575 |
| 4,123,034 | A | * | 10/1978 | Crunk et al. | 249/156 |
| 4,424,951 | A | * | 1/1984 | Spencer | 249/48 |
| 4,666,643 | A | * | 5/1987 | Spencer | 264/31 |
| 4,958,800 | A | * | 9/1990 | Carlson | 249/219.1 |
| 5,524,861 | A | * | 6/1996 | Solomon | 249/27 |
| 5,651,659 | A | * | 7/1997 | Myers et al. | 414/814 |

(Continued)

FOREIGN PATENT DOCUMENTS

DE 3114744 A1 * 5/1982 ..... E02D 27/04

*Primary Examiner* — Christine T Cajilig
(74) *Attorney, Agent, or Firm* — Price Heneveld LLP

(57) ABSTRACT

A unitary assembly facilitates constructing concrete foundation pads made of poured concrete, the foundation pads being useful to support a structure or building. The apparatus comprises a unitary assembly of existing planar forms connected by taper-shaped corners using wedge connectors to define an upwardly-tapered cavity shaped to hold poured concrete until the concrete cures. The assembly is sufficiently rigid and the planar forms are held at an angle sufficient for the unitary assembly to self-release from the cured concrete without disassembly when lifted/moved vertically off of the cured concrete.

8 Claims, 5 Drawing Sheets

(56) References Cited

U.S. PATENT DOCUMENTS

| | | | | |
|---|---|---|---|---|
| 6,676,102 | B1 | 1/2004 | Hambelton | |
| 6,865,859 | B2 * | 3/2005 | Flathau | 52/742.14 |
| 8,485,493 | B2 * | 7/2013 | Wells et al. | 249/48 |
| 8,535,592 | B2 * | 9/2013 | Halischuk | 264/334 |
| 2004/0175243 | A1 * | 9/2004 | Correia | 405/284 |
| 2005/0097831 | A1 * | 5/2005 | Rose | 52/98 |
| 2009/0025336 | A1 * | 1/2009 | Prenn | 52/835 |
| 2009/0245943 | A1 * | 10/2009 | Blundell | 405/286 |
| 2010/0258704 | A1 * | 10/2010 | Corredor Molguero et al. | 249/117 |

* cited by examiner

UNITARY FORM FOR POURED FOUNDATION PAD AND METHOD

This application claims benefit under 35 USC §119(e) of provisional application Ser. No. 61/710,934, filed Oct. 8, 2012, entitled UNITARY FORM FOR POURED PIER PAD AND METHOD, the entire contents of which are incorporated herein by reference.

BACKGROUND

The present invention relates to reusable forms for containing poured concrete until cured, such as are used for constructing concrete foundation pads (also called "pier pads" herein).

Forms are used to contain concrete until it cures sufficiently to hold its shape. One such use is for constructing pier pads to support building columns, such as are often used in large buildings. Such forms are often made reusable and are releasably connectable, so that a given set of forms can be repeatedly disassembled and pulled off of a cured concrete structure and then reassembled/reused to construct additional such structures at other locations on the same job site. A problem is that large building may include a large number of pier pads, thus requiring repeated assembly and disassembly of a set of forms. The repeated assembly and disassembly of forms is manually intensive, time-consuming, and generally inefficient.

SUMMARY OF THE PRESENT INVENTION

In one aspect of the present invention, an apparatus is provided to facilitate constructing concrete foundation pads made of poured concrete. The apparatus includes an assembly defining an upwardly-tapered cavity shaped to hold poured concrete until the concrete cures sufficiently to hold its shape and form a concrete foundation pad. The assembly includes angled side surfaces so that the assembly self-releases from the cured concrete when moved vertically off of the cured concrete without disassembly.

In a narrower aspect, the unitary assembly includes a plurality of forms interconnected with corners.

In yet a narrower aspect, the forms are existing forms including a planar inner surface forming, and the corners interconnect the existing forms using wedge connectors, including positioning the existing forms at a vertical angle.

In yet a narrower aspect, the corners include lift members that can be engaged and lifted using an overhead device, such as a crane.

In another aspect of the present invention, a corner apparatus is provided that is adapted to interconnect existing planar forms used for forming a concrete foundation pad, the existing forms including a planar inner surface and first connectors at ends. The corner apparatus includes a corner having a wide end tapering to a narrow end and having first and second edges each with mating connectors for connection to the first connectors. When connected, the corners position the planar inner surfaces of the existing forms at an inward angle so that a cavity formed by an assembly of the corners and the existing forms defines an upward tapered assembly that releases from cured concrete when moved vertically off of the cured concrete without disassembly.

In another aspect of the present invention, a method is provided for constructing concrete foundation pads made of poured concrete. The method includes providing a unitary assembly defining an upwardly-tapered cavity, pouring concrete into the cavity and allowing the concrete to cure, and once the concrete is sufficiently cured to hold its shape and form a concrete foundation pad, lifting the unitary assembly to release the unitary assembly from the cured concrete without disassembly. The method also includes reusing the unitary assembly without disassembly.

In another aspect of the present invention, a method of construction includes pouring concrete into a unitary unit defining a cavity with inwardly angled sides, allowing the concrete to cure, lifting the unitary unit vertically off the cured concrete leaving cured concrete forming a concrete foundation pad for a building column, positioning the unitary unit in a second location, and repeating the above steps as needed.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 9:
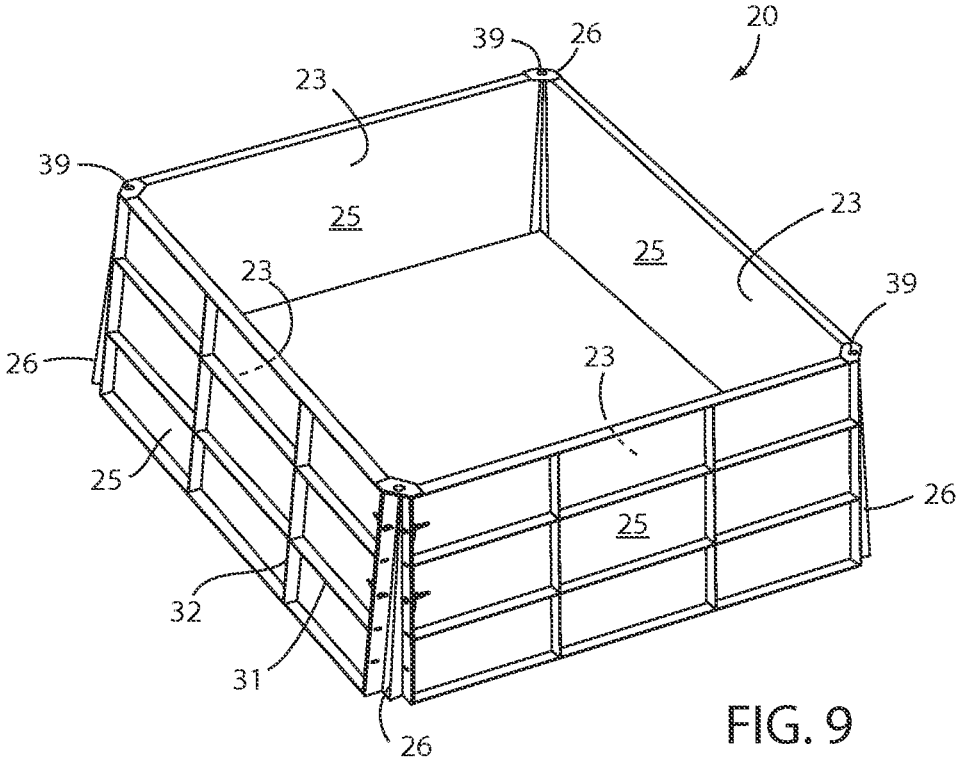
FIGS. 9-12 are perspective views of the apparatus of FIG. 1 (or FIG. 3) showing a method of use, including the assembly resting empty on the ground (FIG. 9), filled with poured concrete (FIG. 10), attached to a crane by corner-attached chains (FIG. 11), and lifted vertically by the crane with the cured concrete forming a pier pad for supporting a building column (FIG. 12).

An apparatus 20 (also called "unitary assembly" herein) (FIGS. 1, 3 and 9-12) is provided to facilitate constructing concrete foundation pads 21 (FIG. 12) (also called "pier pads" herein) made of poured concrete, the pier pads 21 being a structural foundation used, for example, for supporting a building column often used in buildings. The illustrated apparatus 20 comprises an assembly (FIG. 9) of planar forms 25 and interconnecting corners 26 that, when assembled, define an upwardly-inwardly-tapered cavity shaped to hold poured concrete 22 (FIG. 10) until the concrete cures sufficiently to hold its shape and form a pier pad 21 (FIGS. 11-12) for supporting a building column. The planar forms 25 are angled by the corners 26 sufficiently so that the unitary assembly 20 self-releases from the cured concrete (FIG. 12) when moved vertically off the cured concrete without disassembly. Thus, the assembly 20 can be reused at a second location without disassembly and reassembly, which saves considerable time and effort.

Figure 1:
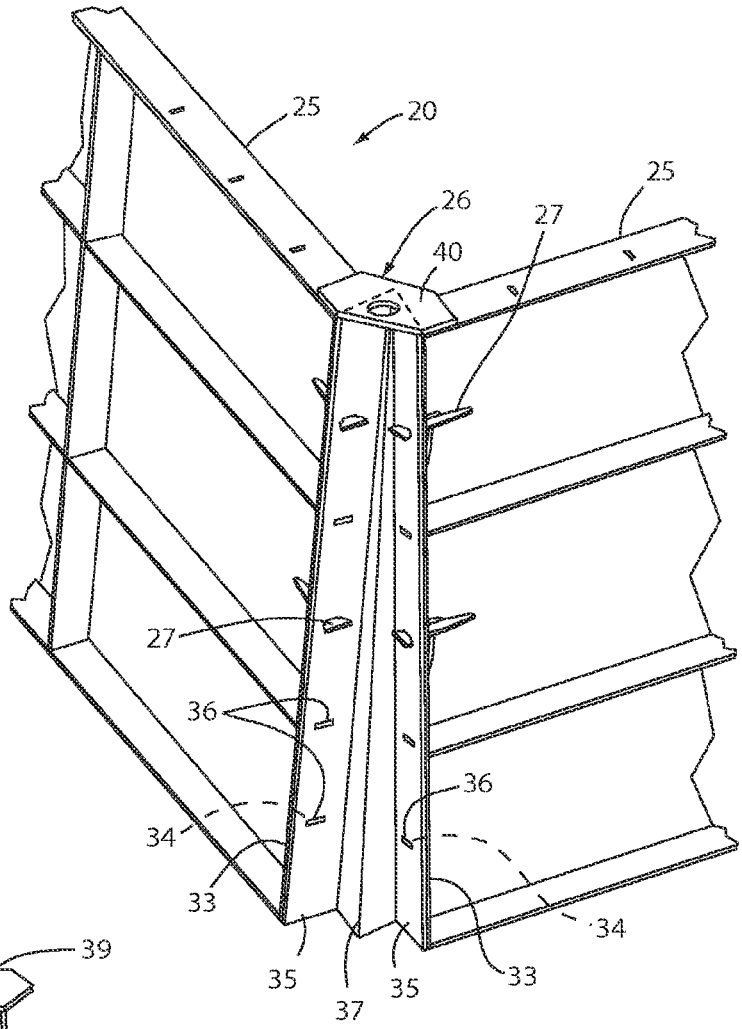
FIG. 1 is a perspective fragmentary view of an apparatus adapted to facilitate constructing concrete foundation pads made of poured concrete, the apparatus including a unitary assembly of existing forms interconnected by novel corners so that the forms angle inwardly, thus allowing vertical release without disassembly.
Figure 2:
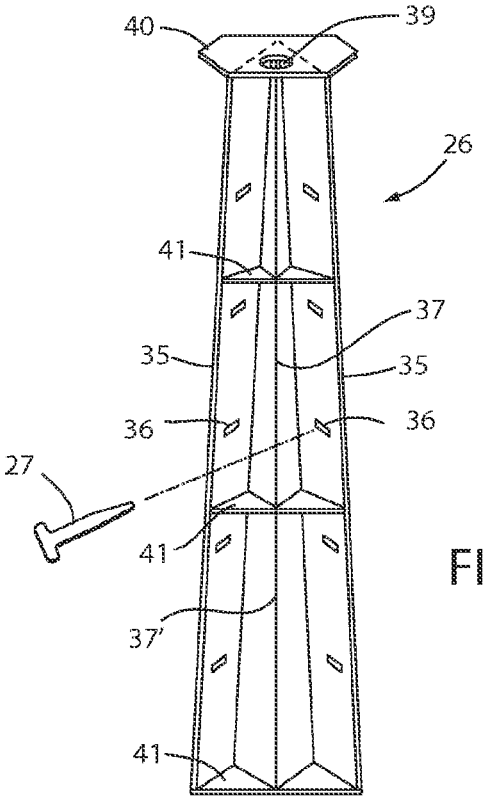
FIG. 2 is a perspective view of the corner shown in FIG. 1.
Figure 11:
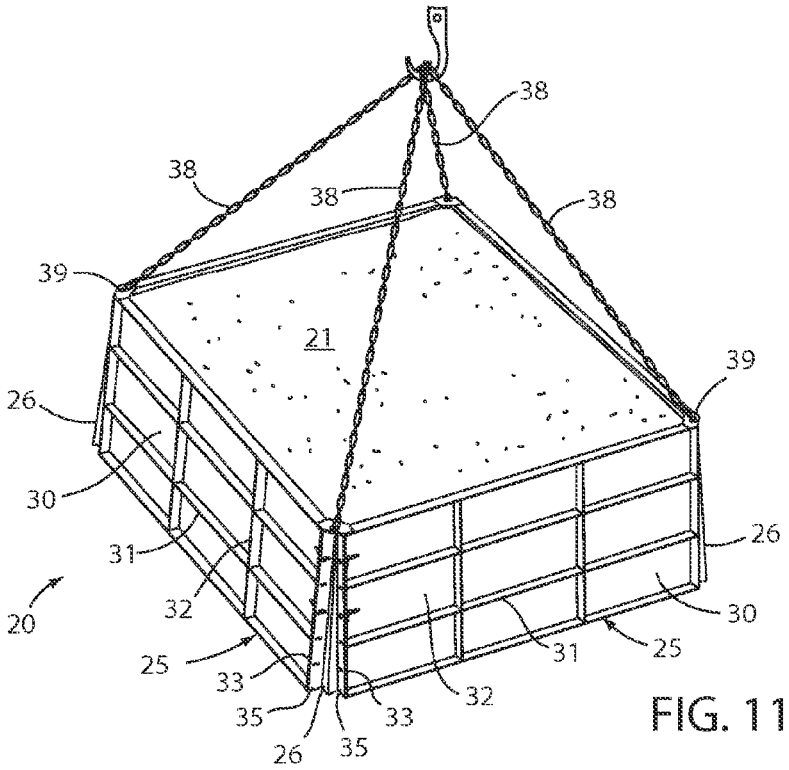
Figure 12:
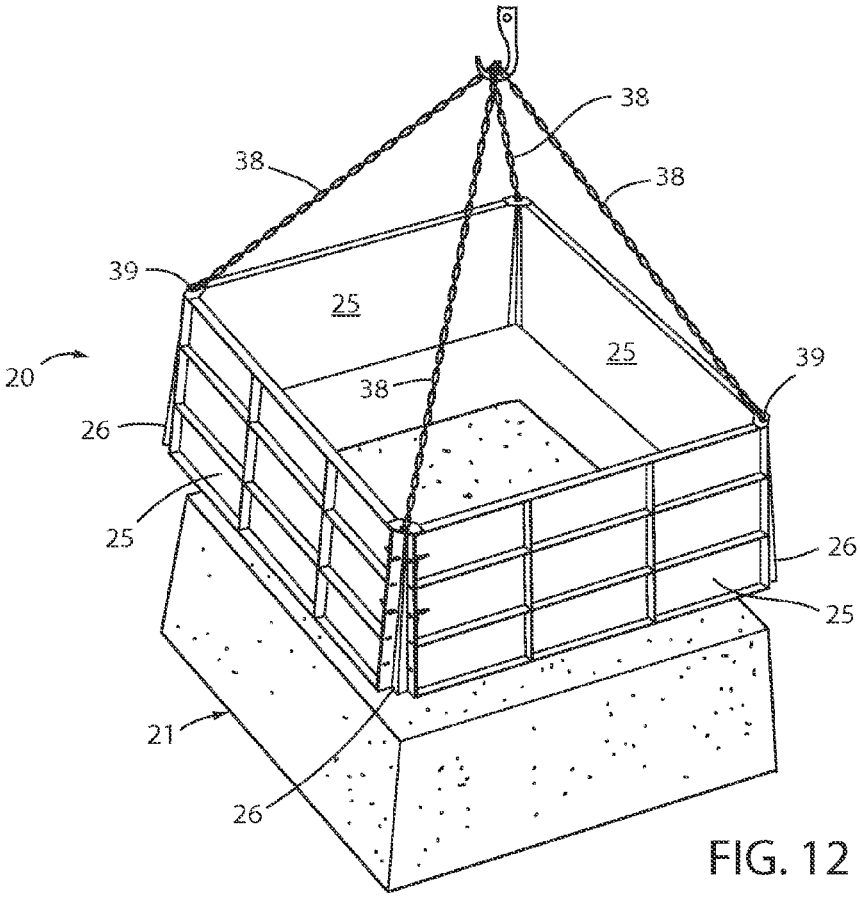

The illustrated unitary assembly 20 (FIG. 9) includes four existing forms 25 (more could be used if needed) and four corners 26 interconnecting the forms 25 to form an assembled unit of sufficient rigidity and solidity so that it can be lifted (see FIG. 12) as a unit and reused, as noted above. The present concrete structural pad corner 26 (FIGS. 1-2) is made of steel, and is constructed to receive wedge connectors 27 for its connection to the existing concrete forms 25. Specifically, the forms 25 (FIG. 11) each include a planar panel 30 forming their inner concrete-containing surface, reinforcements 31 and 32 on the planar panel 30 to maintain shape, and end plates 33 with slots 34 (FIG. 1). The corners 26 include mating end plates 35 with slots 36. When the end plates 33 and 35 are mated together, the slots 34 and 36 align and receive wedge-connectors 37. A wedge-shaped spreader 37' (FIG. 1) connects the corner's end plates 35 to define a "W" shaped cross-section with narrow top and wide bottom. When the concrete forms 25 are attached to the pier pad corners 26, the forms 25 are positioned at a 2-to-4 degree pitch, with all four forms 25 being pitched on all sides of the pad 21 sufficiently to allow relief lifting the assembly as a unit (FIG. 12). The illustrated pier pad corners 26 include a top aperture gusset 40 with lifting hole 39 to allow attachment of lifting chains 38 (FIG. 11-12) or attachment of hooks, cables, straps, devises, or other lifting device(s). Gussets 41 can be added to stiffen the section of the corners 25 if necessary.

Figure 3:
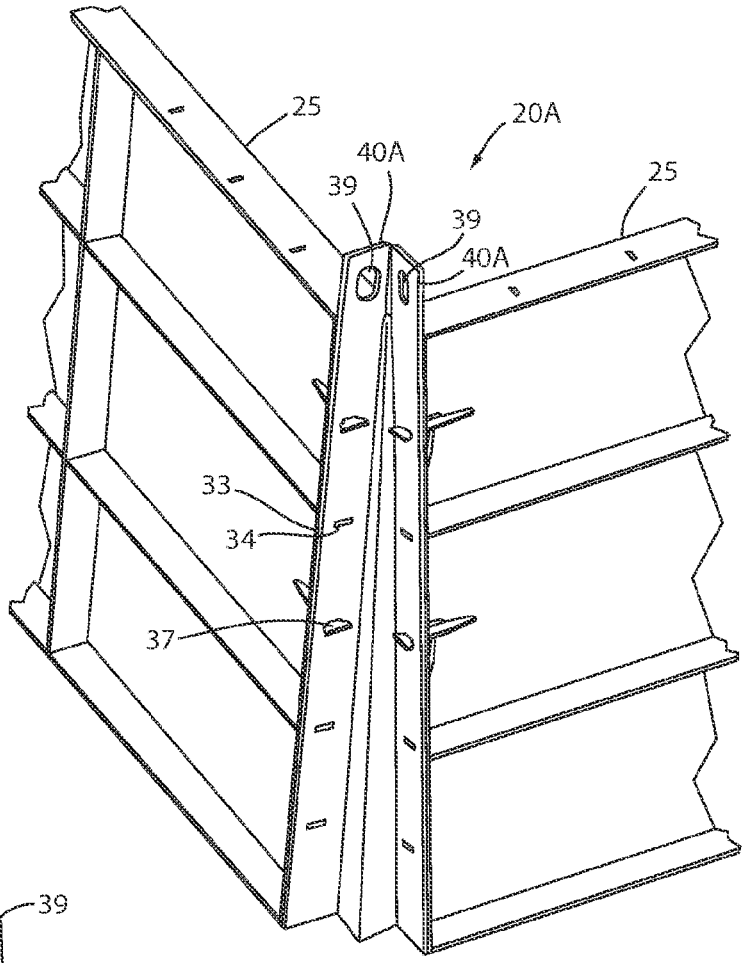
FIG. 3 is a perspective fragmentary view of a modified apparatus similar to FIG. 1, but having a modified corner.
Figure 4:
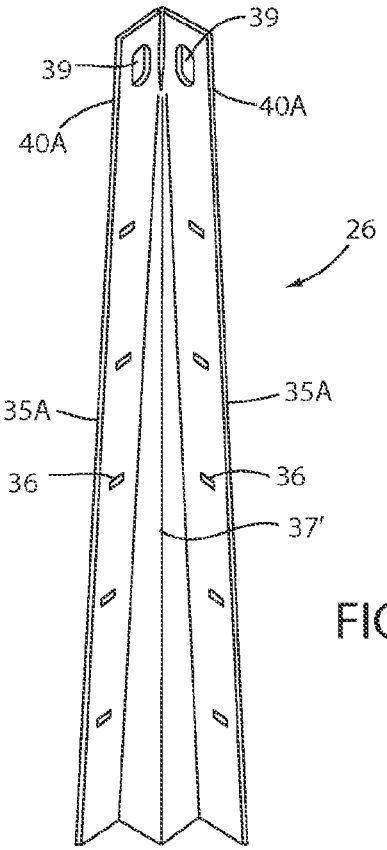
FIG. 4 is a perspective view of the corner shown in FIG. 3.
Figure 5:
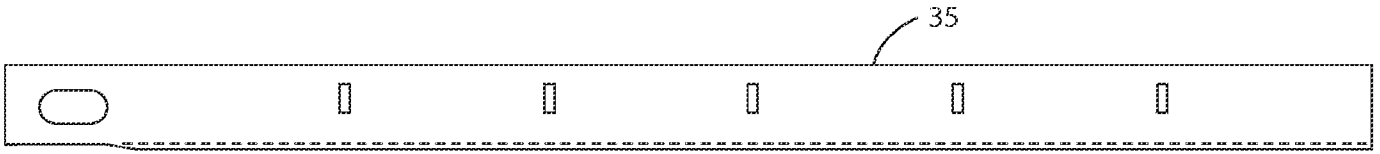
FIG. 5 is a side view of the side panel of the corner in FIG. 4.
Figure 6:
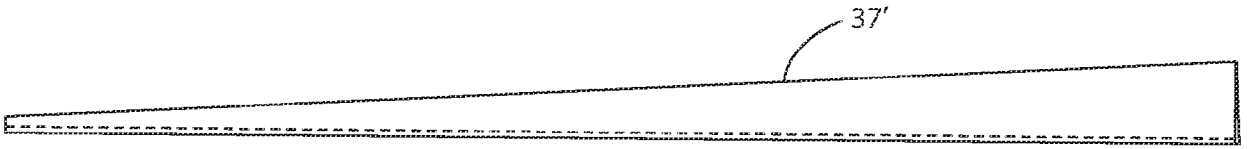
FIG. 6 is a side view of the V-shaped center section of the corner in FIG. 4.
Figure 7:
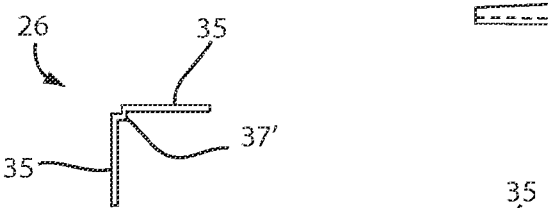
FIGS. 7-8 are top and bottom end views of FIG. 4, with the components of FIGS. 5-6 welded together.
Figure 8:
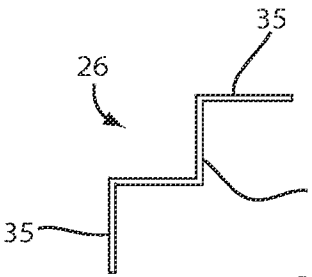

FIGS. 3-4 show a modified corner 26A, where an apertured top section 40A extends from the corner's end plate 35A and replaces the top aperture gusset 40. The section 40A includes an opening 39 (also called a "lifting aperture" herein) for receiving a chain to lift the apparatus 20. Notably, triangular-shaped gussets 41 can be incorporated along a length of the corner 26A (of corner 26) to maintain a rigidity and non-deforming strength of the corner 26A (or corner 26) if desired.

As noted above, the corner apparatus 20 is provided that is adapted to interconnect existing planar forms 25 used for forming a pier pad 21 for supporting a building column. The existing forms 25 include a planar inner surface and include first wedge connectors 37 at ends. The corners 26 have a wide end tapering to a narrow end and have first and second edges that mate against ends of the planar forms 25. An angle defined by the corners 26 can be varied as needed for particular constructions/jobs, such as 2-5 degrees or more. The corner's edges each have mating wedge connectors for connection to the first wedge connectors in the planar forms 25. When connected, the corners 26 position the planar inner surfaces of the existing forms at an upward/inward angle so that a cavity formed by an assembly of the corners 26 and the existing planar forms 25 defines an upward inwardly tapered assembly that can be self-released from cured concrete when moved vertically off the cured concrete without disassembly of the apparatus 20. It is noted that a scope of the present invention can include other connectors instead of wedges, such as bolts or the like. It is also contemplated that a scope of the present invention includes other shapes different than a square upwardly-inwardly-tapered shape, such as other polygonal shapes and/or conical shapes and/or curved shapes.

Figure 10:
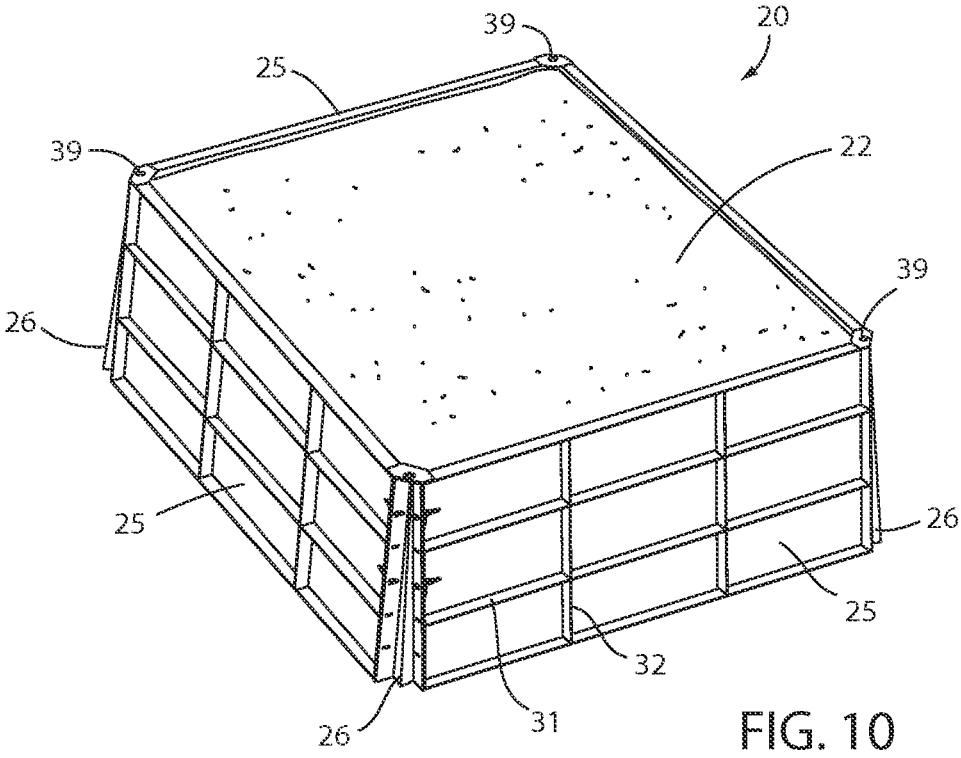

The present innovation also supports a novel method for constructing concrete foundation pads 21 made of poured concrete 22, such as are used for supporting a building column. Specifically, the method includes providing an assembly defining an upwardly-inwardly-tapered cavity (FIG. 9), pouring concrete into the cavity and allowing to the concrete to cure (FIG. 10). Once the concrete is sufficiently cured to hold shape and form a pier pad 21, the method includes connecting a lifting device (FIG. 11) and lifting the unitary assembly 20 to release the unitary assembly 20 from the cured concrete without disassembly (FIG. 12). The methods then provides steps of reusing the unitary assembly 20 (without disassembly or reassembly), resulting in substantial savings in reduced manual labor to repeatedly disassemble and reassemble the forms for each separate pier pad 21.

More succinctly, the present method of construction includes pouring concrete into a unitary assembly 20, allowing the concrete to cure, and without disassembly, lifting the unitary assembly 20 vertically off of the cured concrete to leave cured concrete forming a pier pad for a building column. The method further includes positioning the unitary assembly 20 in a second location, and repeating the above steps to form additional pier pads 21.

FIGS. 9-12 are perspective views of the apparatus of FIG. 3 showing a method of use, including the assembly resting empty on the ground (FIG. 9), filled with poured concrete (FIG. 10), attached to a crane by corner-attached chains (FIG. 11), and lifted vertically by the crane with the cured concrete forming a pier pad for supporting a building column (FIG. 12).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A self-release assembly for facilitating the construction of concrete foundation pads, the self-release assembly comprising:

a plurality of reinforced planar forms having end plates at their sides;

each of the reinforced planar forms being connected at their sides by corner pieces;

each of the planar forms being configured to be angled so as to taper inwardly and upwardly from their base up to their top surfaces;

each of the corner pieces include corner end plates which are connected to the end plates of the reinforced planar forms by wedge connectors;

each of the corner plates include wedge shaped spreaders; the corner plates and the wedge shaped spreaders being configured to be angled so as to taper inwardly and upwardly from their base to their top surfaces;

wherein the wedge shaped spreaders and corner end plates substantially form a W-shape at their bases and substantially form a V-shape at the top of each of the corner pieces; and wherein after concrete is poured into the assembly and cured, the unitary assembly is configured to be lifted vertically off of the concrete foundation pad and be reused without any disassembly.

2. The apparatus of claim 1, wherein the corner pieces each include a narrow end and a wide end.

3. The apparatus of claim 1, wherein the corner pieces each include an interior surface defining a cavity within the assembly.

4. The apparatus of claim 1, wherein the corner pieces each include a lift member comprising a hole or structural feature that can be engaged with a lift device.

5. The apparatus of claim 1, further including a plurality of spaced holes along a top of the assembly which are arranged to receive a lift chain for balanced non-tilting overhead lift of the assembly.

6. A method of facilitating the construction of concrete foundation pads using a self-release assembly, the method comprising:

providing a plurality of reinforced planar forms having end plates at their sides;

connecting each of the reinforced planar forms at their sides by corner pieces;

angling each of the planar forms to taper inwardly and upwardly from their base up to their top surfaces;

providing each of the corner pieces with corner end plates which are connected to the end plates of the reinforced planar forms by wedge connectors;

providing each of the corner plates with wedge shaped spreaders, wherein the corner plates and the wedge shaped spreaders are angled so as to taper inwardly and upwardly from their base to their top surfaces;

wherein the wedge shaped spreaders and corner end plates substantially form a W-shape at their bases and substantially form a V-shape at the top of each of the corner pieces; and wherein after concrete is poured into the assembly and cured, the unitary assembly is configured to be lifted vertically off of the concrete foundation pad and be reused without any disassembly.

7. The method of claim 6, further providing each of the corner pieces with a lift member comprising a hole or structural feature that can be engaged with a lift device.

8. The method of claim 6, further providing a plurality of spaced holes along a top of the assembly which are arranged to receive a chain for balanced non-tilting overhead lift of the assembly.

* * * * *